US009572470B2

(12) United States Patent
Fischer et al.

(10) Patent No.: US 9,572,470 B2
(45) Date of Patent: Feb. 21, 2017

(54) CABLE-ACTUATED LIFT SYSTEM

(71) Applicant: Kärcher North America, Inc., Englewood, CO (US)

(72) Inventors: Andrew Fischer, Englewood, CO (US); Ronald Matthew Forbes, Englewood, CO (US)

(73) Assignee: Kärcher North America, Inc., Englewood, CO (US)

( * ) Notice: Subject to any disclaimer, the term of this patent is extended or adjusted under 35 U.S.C. 154(b) by 507 days.

(21) Appl. No.: 14/022,716

(22) Filed: Sep. 10, 2013

(65) Prior Publication Data

US 2014/0068885 A1 Mar. 13, 2014

Related U.S. Application Data

(60) Provisional application No. 61/699,155, filed on Sep. 10, 2012.

(51) Int. Cl.
*A47L 11/40* (2006.01)

(52) U.S. Cl.
CPC ..... *A47L 11/4055* (2013.01); *A47L 11/4044* (2013.01); *A47L 11/4058* (2013.01)

(58) Field of Classification Search
CPC ..... A47L 11/4055; A47L 11/4058; A47L 11/4052; A47L 11/4044
USPC ..... 15/49.1, 50.1, 98, 320, 401, 402
See application file for complete search history.

(56) References Cited

U.S. PATENT DOCUMENTS

| | | | | |
|---|---|---|---|---|
| 2,655,678 | A * | 10/1953 | Keogh | E01H 1/053 15/87 |
| 3,292,195 | A * | 12/1966 | Schmidt | E01H 1/053 15/87 |
| 4,334,335 | A | 6/1982 | Brown et al. | |
| 4,729,141 | A * | 3/1988 | Berg | A47L 11/162 15/340.4 |
| 5,555,596 | A | 9/1996 | Knowlton et al. | |
| 6,519,808 | B2 | 2/2003 | Legatt et al. | |
| 7,448,114 | B2 | 11/2008 | Basham et al. | |
| 7,533,435 | B2 | 5/2009 | Pedlar et al. | |
| 7,685,968 | B2 | 3/2010 | Cooper | |
| 8,245,345 | B2 | 8/2012 | Pedlar et al. | |
| 2011/0107529 | A1 | 5/2011 | Hetler | |

FOREIGN PATENT DOCUMENTS

| | | |
|---|---|---|
| CN | 1144076 | 3/1997 |
| CN | 201139519 | 10/2008 |

(Continued)

OTHER PUBLICATIONS

Definition of pulley in Merriam-Webster Dictionary, 2016.*

(Continued)

*Primary Examiner* — Larry E Waggle, Jr.
*Assistant Examiner* — Andrew A Horton
(74) *Attorney, Agent, or Firm* — Sheridan Ross P.C.

(57) ABSTRACT

A lift device is provided which allows a surface-contacting feature to articulate. The device raises and lowers a squeegee regardless of its lateral location. An actuator arm is provided on one end of a pivot arm channel such that when the actuator arm fully extends it disengages from the one end of the pivot arm channel. An actuator cable remains in tension such that it may be raised or lowered regardless of whether the surface-contacting feature's lateral position.

13 Claims, 4 Drawing Sheets

(56) References Cited

FOREIGN PATENT DOCUMENTS

| | | |
|---|---|---|
| CN | 101346088 | 1/2009 |
| CN | 101384380 | 3/2009 |
| WO | WO 95/13737 | 5/1995 |
| WO | WO 2011/057253 | 5/2011 |

OTHER PUBLICATIONS

Extended Search Report for European Patent Application No. 13834545.9, dated Jul. 15, 2015 9 pages.
International Preliminary Report on Patentability for International (PCT) Patent Application No. PCT/US13/58890 mailed Mar. 10, 2015, 8 pages.
International Search Report and Written Opinion for International (PCT) Patent Application No. PCT/US13/58890 mailed Feb. 10, 2014, 9 pages.
English Translation of Official Action for China Patent Application No. 201380014266.5, dated Dec. 28, 2015 11 pages.
English Translation of Official Action for China Patent Application No. 201380014266.5, dated Aug. 8, 2016 9 pages.

* cited by examiner

CABLE-ACTUATED LIFT SYSTEM

This U.S. Non-Provisional patent application claims the benefit of priority from U.S. Provisional Patent Application Ser. No. 61/699,155, filed Sep. 10, 2012, the entire disclosure of which is hereby incorporated by reference in its entirety.

FIELD OF THE INVENTION

The present disclosure generally relates to apparatuses for treating surfaces. More specifically, the present disclosure relates to a lift device for vertical manipulation of various components, including a squeegee system for ride-on, self-propelled cleaning machines.

BACKGROUND

Many industries use cleaning machines to clean a wide variety of surfaces. The sophistication of cleaning machines has evolved at a rapid pace over time. An older form of cleaning machine is the basic mop-and-bucket device, which still has viability in some contexts. However, such a device is labor-intensive and time consuming. Further, dirt cleaned from a surface accumulates in the bucket, rendering the mop-and-bucket device inefficient.

The next iteration of cleaning machine is the manually-propelled cleaning machine. This type of cleaning machine has an unspent treatment fluid reservoir and a spent treatment fluid reservoir, which solves the mop-and-bucket's problem of accumulated dirt. Also, a manually-propelled cleaning machine combines many aspects of cleaning a floor such that a user may clean a floor as he or she propels the cleaning machine forward. Thus, the manually-propelled cleaning machine is not as labor-intensive as the mop-and-bucket device. Yet, the user of a manually-propelled cleaning machine is still exerting effort to move the machine around.

Finally, the latest class of cleaning machine is the self-propelled cleaning machine, which can either be walk-behind or ride-on. The self-propulsion aspect of this type of cleaning machine offers an improvement over the more labor-intensive, manually-propelled type of cleaning machine. As a result, a self-propelled cleaning machine may clean larger surface areas more quickly.

A common component of the manually-propelled and self-propelled cleaning machines is the vacuum squeegee. The vacuum-enabled squeegee collects the spent treatment fluid and particulate matter on the floor and places them into a spent treatment fluid reservoir. The vacuum squeegee is usually affixed behind the cleaning machine such that it is the last component of the machine that contacts the surface. Usually, the vacuum squeegee is interconnected to a vacuum pump or fan in order to provide the suction necessary to remove spent treatment fluid and particulate matter off of the floor and into the spent treatment fluid reservoir.

One issue with vacuum squeegees is that they are somewhat delicate. For example, some vacuum squeegees may be damaged if the cleaning machine travels in reverse. To this point, U.S. Pat. No. 4,334,335 to Brown et al., which is hereby incorporated by reference in its entirety, discloses a hydraulic system which raises and lowers a vacuum squeegee. The hydraulic system will automatically raise the vacuum squeegee if the cleaning machine is traveling in reverse and lower the vacuum squeegee if the cleaning machine is traveling forward.

In a similar vein, vacuum squeegees may also be damaged by obstacles on the cleaning machine's path. A modern solution to this issue is to interconnect the vacuum squeegee to a lift device which raises and lowers the vacuum squeegee on the user's command. U.S. Pat. No. 7,448,114 to Basham et al., which is hereby incorporated by reference in its entirety, utilizes a lift device which comprises a lift cylinder, a pivot arm, and a cable. The lift cylinder actuates the pivot arm which is connected to the cable such that the cable raises and lowers the vacuum squeegee on the user's command.

A further issue with vacuum squeegees is performance-related. Namely, a squeegee which is in a fixed position against the floor, or even one that simply raises up and down, will miss collecting spent fluid and particulate matter when making a tight turn.

U.S. Pat. No. 7,533,435 to Pedlar et al., which is hereby incorporated by references in its entirety, discloses a device which allows a vacuum squeegee to swing out to either side of the cleaning machine as it cleaning machine executes a turn. The vacuum squeegee is interconnected to a linkage arm which is interconnected to the main body of the cleaning machine at a single point. Further, the vacuum squeegee is selectively interconnected to a roller track which allows the vacuum squeegee to swing to either side of the cleaning machine, pivoting in an arc about the point where the linkage arm interconnects to the main body of cleaning machine. When the cleaning machine turns, the friction between the vacuum squeegee and the floor pulls the vacuum squeegee to the side of the cleaning machine, and the vacuum squeegee collects more spent treatment fluid and particulate matter. However, this particular vacuum squeegee is located underneath the cleaning machine, not trailing behind. Thus, the raising and lifting capability of this particular invention is limited.

Beyond, the aforementioned references, cleaning machines still retain a litany of deficiencies. For example, some cleaning machines have a vacuum squeegee which is able to swing to either side of the cleaning machine as well a lift capability to raise and lower the vacuum squeegee. However, the squeegee must be directly behind the cleaning machine before it may be raised off of the floor. This deficiency prevents the cleaning machine from avoiding obstacles while making turns with the vacuum squeegee swung out to either side of the cleaning machine.

SUMMARY OF INVENTION

It is therefore an object of the present disclosure to provide the ability to raise or lower a vacuum squeegee or similar component of a cleaning machine. It is a further object of the present disclosure to provide such a feature that allows movement of the component while the machine executes a turn, and further allows the component to swing out to either side of the machine.

It is also an object of the present disclosure to provide a cable actuated system for retracting system components that minimizes the amount of space or volume required for the system. As devices of the present disclosure are typically incorporated into larger devices and systems, it is advantageous to provide features of the present disclosure in a generally compact fashion.

Embodiments of the present disclosure provide for a cable-actuated system adapted to transmit a force and adjust at least a vertical position of components, such as a floor squeegee device.

In one embodiment, the present invention comprises a cable actuated lift device comprising a cable having a predetermined length, a first end of the predetermined length of cable provided in force transmitting communication with a linear actuator. The cable is connected to the linear actuated by way of a rotatable linkage member (e.g. rotatable plate) and a substantially horizontal pulley, the substantially horizontal pulley being translatable within a predetermined path to extend the cable. A second end of the predetermined length of cable is provided in force transmitting communication with a surface cleaning device, such as a squeegee. The linear actuator comprises an extended and retracted position, and is adapted to extend and retract the length of cable by imparting force to the rotatable linkage member and the substantially horizontal pulley such that the extended position of the linear actuator corresponds to the surface cleaning device being provided in contact with a surface and the retracted position corresponds to the surface cleaning device being provided in a raised position with respect to the surface. This actuation may be controlled by a user, including user-operation of a console switch, lever, or similar feature. The predetermined length of cable extends from the horizontal pulley in a horizontal direction, so as to reduce the required vertical height or space required of the mechanism. The cable is further provided in contact with a second pulley, the second pulley comprising a transition point between the horizontal direction of the cable and a direction comprising at least a downward component. The second pulley is rotatable about a first axis as is standard among pulley, and also pivotable about a second axis, the second axis such that the pulley and cable may be angled at various downward angles and allow the cable to pivot, thus allowing the interconnected cleaning device to translate or pivot in a generally side-to-side manner. Pivoting of the second pulley about the second axis permits translation of the surface cleaning device at least when the surface cleaning device is provided in contact with a surface. Cable lift devices of the present invention are contemplated for use within floor cleaning devices including, for example, those described in U.S. Pat. No. 8,245,345, the entire disclosure of which is hereby incorporated by reference in its entirety.

In various embodiments, a cable actuated system allows cable to deploy and an associated squeegee or surface-contacting device to extend, track, or travel in a substantially unrestricted path. The system is further capable of retracting the surface-contacting device by applying a linear force upon system components as shown and described herein. Various articulating and translatable features of the present disclosure provide for extension and retraction of a cable and associated device, while minimizing required space for the system and accounting for slack and travel of the cable such that overall system wear and required maintenance is minimized.

The present disclosure contemplates providing a cable actuated lifting system for transmitting at least a vertical force to a component, the system comprising a first guide pulley rotatable about an axis, a translatable pulley, and an actuator. Devices and systems of the present disclosure provide for a compact system that accommodates for slack and stress of a cable or wire and preserves the usable lifespan of system components.

In various embodiments, an actuator is provided in connection with a pivot arm. The actuator comprises an elongate arm in communication with a lift cylinder. When the lift cylinder generates a force, the actuator arm extends or retracts linearly. One end of the actuator arm comprises an upwardly extending protrusion and a downwardly extending protrusion. These protrusions selectively interconnect with a channel in the pivot arm and a notch in a support bar. When the actuator arm is retracted, the weight of the vacuum squeegee secures one end of the pivot arm channel and the notch in the support bar against the protrusion on the end of the actuator arm. As the actuator arm extends and lowers the squeegee, the protrusions of the actuator arm disengage from the pivot arm channel and support bar notch.

In one embodiment, the pivot arm is secured to the frame of the cleaning machine at a single point such that the motion of the pivot arm is in the horizontal plane. The end of the pivot arm is interconnected to a first pulley. As the actuator moves the pivot arm, this pulley travels in an arc about the pivot point of the pivot arm.

A third component, the lifting frame, has an arc-shaped channel that the first pulley travels in as the pivot arm moves. At one end of the lifting frame is a second pulley. The vertical pulley is interconnected an axle which is in turn selectively interconnected to the lifting frame. The axle allows the vertical pulley to gimbal or rotate about an axis (e.g. towards the left and right sides of the cleaning machine).

A single cable interfaces with the pulleys. This cable terminates at the horizontal pulley and then travels horizontally to the vertical pulley. The vertical pulley allows the horizontal cable to then run downwards to a vacuum squeegee. The gimbal action of the vertical pulley allows the squeegee to swing out to either side of the cleaning machine.

Therefore, as the actuator arm extends, the protrusions allow the pivot arm to rotate forward. As a result, the horizontal pulley on the end of the pivot arm also travels forward in the lifting frame channel, and the horizontal pulley lets the cable travel to the vertical pulley. Here, the vertical pulley converts the horizontal travel of the cable to vertical travel and lowers the vacuum squeegee to the floor. The gimbal action of the vertical pulley allows the squeegee to swing out to the left and right side of the cleaning machine, and the actuator may retract the squeegee off of the floor even if it has swung left or right.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 1:
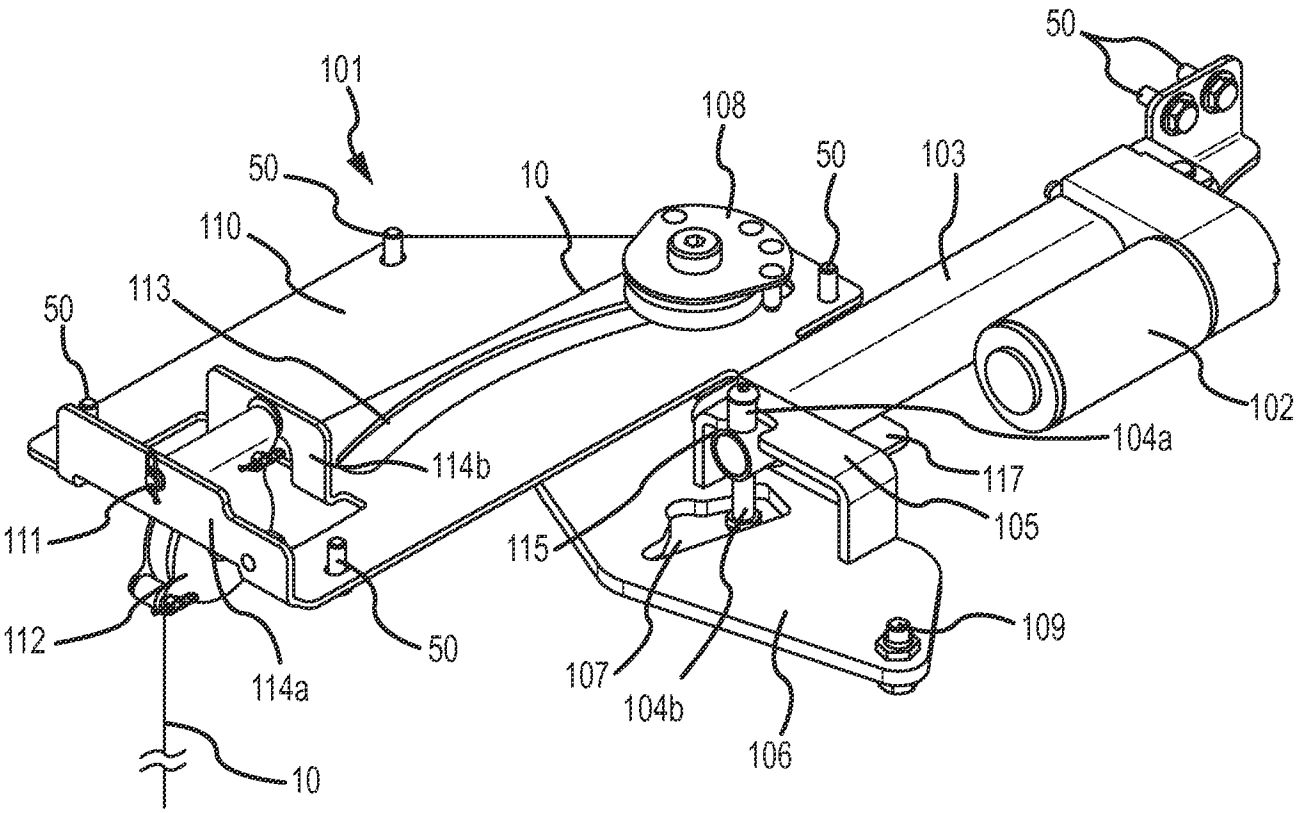
FIG. 1 is an isometric view of the vacuum squeegee assembly of one embodiment of the present disclosure.

FIG. 1 is an isometric view of one embodiment of the present disclosure. As shown, a cable lift device 101 is provided in a lifted or raised position where an associated feature 12 (e.g. a vacuum squeegee) is raised with respect to an associated surface. The lift device 101 comprises a linear actuator device. In various embodiments, the linear actuator device comprises a lift cylinder 102 and a piston 103. A linkage 106, a first pulley 108, a lift frame 110, and a second pulley 112 are provided in communication with a linear actuator device for actuating movement of a cable 10. In various embodiments, the first pulley comprises a first pulley wherein rotation of the pulley member is provided about a substantially vertical axis, and the second pulley comprises a pulley member with rotation provided about a substantially horizontal axis at least in one position of use. The lift cylinder 102 is in communication with the piston 103, which has a moveable actuator arm 116 (see FIG. 2). The lifting cylinder 102 generates a force and communicates this force to the piston 103 where the force drives the actuator arm 116 linearly. The lift cylinder is provided as, for example, a hydraulic user-operated device for applying the required force. In various embodiments, the linear actuator comprises at least one of a hydraulic cylinder, a servo-motor, a geared system, and a rack and pinion system. As shown, the actuator arm 116 comprises protrusions 104*a*, 104*b*. These protrusions 104*a*, 104*b* selectively interface with a support bar 105 and a linkage 106, respectively.

The linkage 106 is interconnected to the floor cleaning machine at least at a pivot point 109. Various additional fasteners 50 or points of connection are provided for securing the lift system 101 to, for example, an underside of a chassis of a cleaning machine. A first pulley 108 is interconnected to the linkage 106. The linkage 106 has a pivot arm channel 107, and the support bar 105 has a notch 115 where both the channel 107 and the notch 115 selectively interface with the two protrusions 104*a* and 104*b*.

In various embodiments, the pivot arm channel 107 is uniquely shaped such that the piston 103 extends linearly as the linkage 106 rotates. A point on the linkage 106 travels in an arc about the pivot point 109 as the linkage 106 rotates forward. However, the actuator arm 116 and the protrusions 104*a* and 104*b* connected to it extend linearly from the piston 103.

In one embodiment, the different motions of the linkage 106 and the actuator arm 116 are accommodated by an ovoid-shaped pivot arm channel 107. When the actuator arm 116 is retracted, the ovoid-shaped pivot arm channel 107 allows the notch 115 in the support bar 105 and the channel 107 to rest against the two protrusions 104*a* and 104*b*. As the actuator arm 116 extends, and the linkage 106 rotates, the ovoid shape allows the two protrusions 104*a* and 104*b* to selectively interface to the pivot arm channel 107 and the notch 115 in the support bar 105 until the vacuum squeegee contacts a surface. At this point, the ovoid-shaped pivot arm channel 107 provides space for the two protrusions 104*a* and 104*b* to continue to extend and disengage from the linkage 106.

The first pulley 108 is provided with a lift frame 110. The lift frame 110 has an arcuate-shaped channel 113 which is generally curved about the pivot point 109. The horizontal pulley 108 travels within the path of the lift frame channel 113 as the vacuum squeegee is raised and lowered. Further, the lift frame has a horizontally extending tongue 117 which supports the piston 103.

Pulley 108 travels relative to pulley 112 which is substantially fixed in its position but capable of rotating about an axis defined by an axle 111. Pulley 108 and provides for amplification of cable motion and/or translation. For example, in certain embodiments, rotation of pulley 108 and corresponding coiling of the cable increases the amount of cable than can be translated as compared with purely translational movement of the pulley and thus increases squeegee translation.

Two upwardly extending flanges 114*a* and 114*b* extend above the lift frame 110. An axle 111 is disposed between the two flanges 114*a* and 114*b*, and a second pulley 112 interfaces with the axle 111 such that the second pulley 112 rotates about an axis defined by the axle 111. In one embodiment, a cable comprises a first terminus at the first pulley 108, the cable being threaded through the second pulley 112, and extending downwardly to interconnect to a vacuum squeegee, for example. The cable is secured to the vacuum squeegee or other associated device by any number of known fasteners. In one embodiment, the cable is secured to the device to be lifted or controlled by standard rigging hardware such as an eye splice provided in a steel cable sometimes referred to as a "molly hogan" or "dutch" eye. Such a feature may be wrapped around a protrusion on a device to be lifted, thereby providing for force-transmitting communication between the two features.

As the cleaning machine executes a turn, machine components such as a squeegee deck rotate or swing so as to accommodate the arc of the turn and collect a trail of liquid that would otherwise be left behind. Such rotation may be a natural consequence of the friction and momentum of the component, or the machine may be provided with features to facilitate such motions. The pivoting action of the vertical pulley 112 as shown and described herein allows the cable to extend and the vacuum squeegee to swing out to either side of the cleaning machine. Additionally, rotation of the first pulley about a substantially vertical axis additionally helps to accommodate such cable movement. When the squeegee is extended or provided off-center, rotation of the pulley 112 about the axis 111 allows the cable 10 to extend at various downward angles. A further advantage of the present invention is that the squeegee or component 12 may be simultaneously raised and centered by the actuator regardless of the position of the component 12 relative to the lift system 101 or machine 14.

Figure 2:
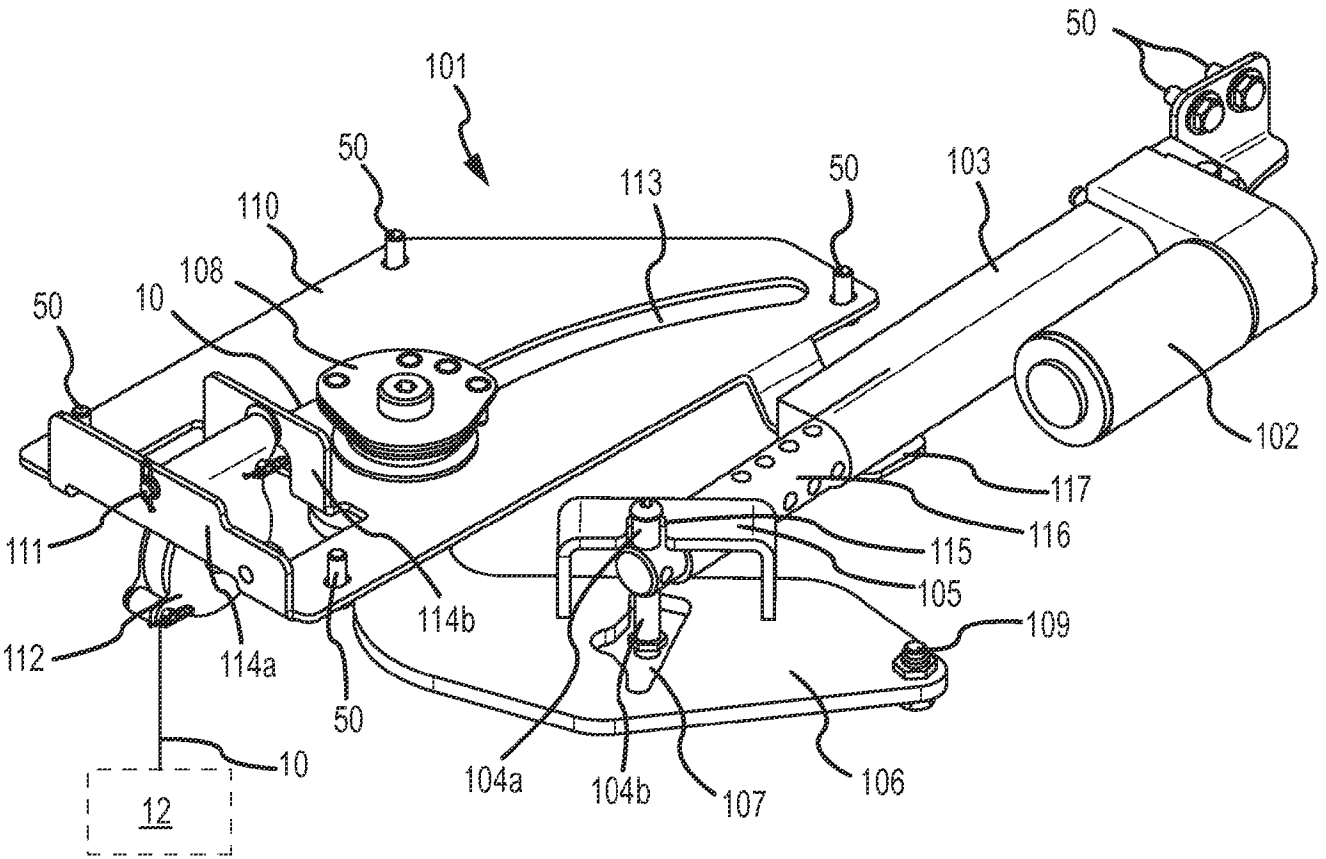
FIG. 2 is an isometric view of the vacuum squeegee assembly of one embodiment of the present disclosure.
Figure 3:
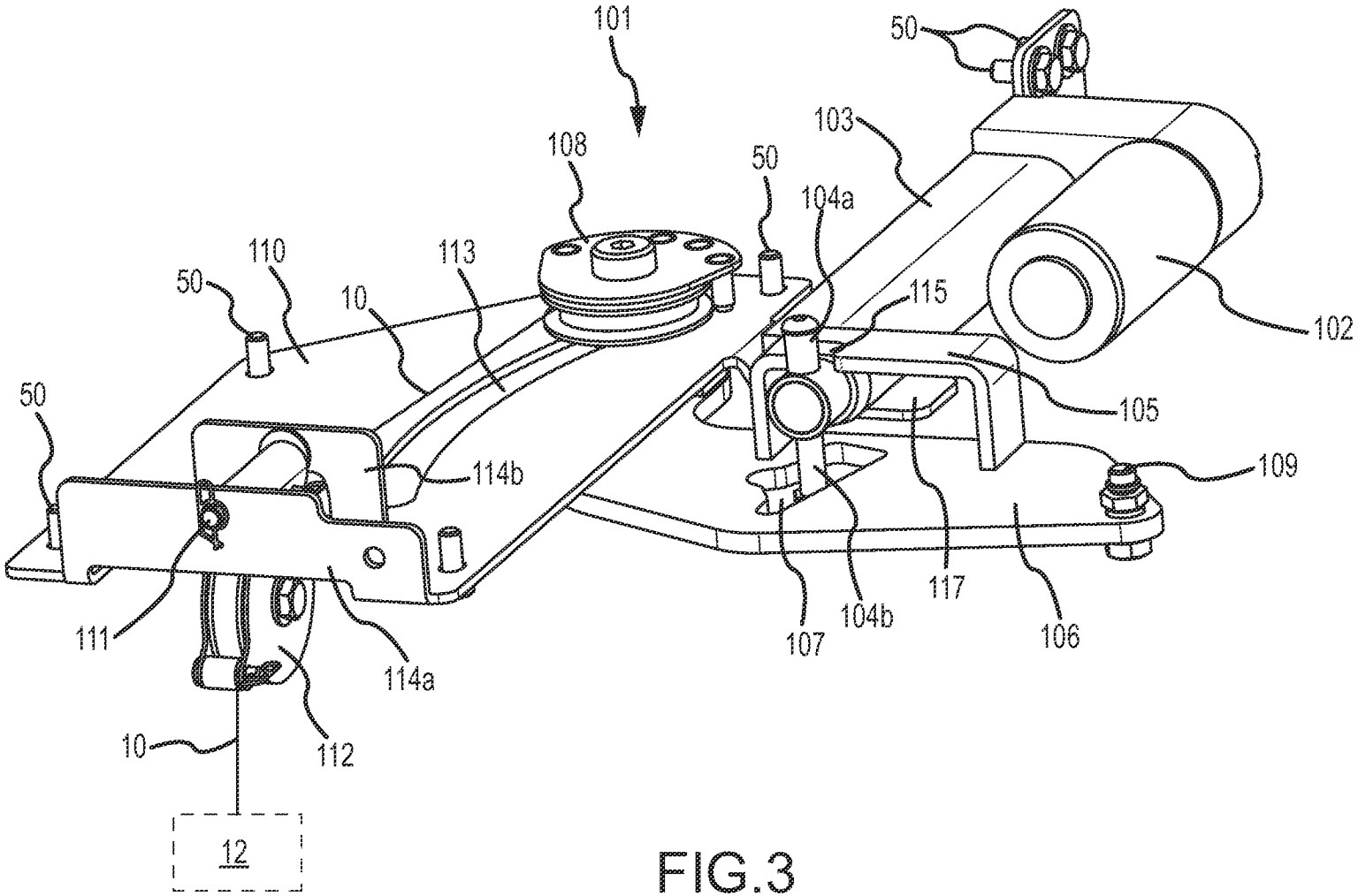
FIG. 3 is a further isometric view of the vacuum squeegee assembly of one embodiment of the present disclosure.

When the lifting device is in the raised position, as seen in FIGS. 1 and 3, the weight of the attached component applies a force to the horizontal pulley 108 via the cable. The support bar notch 115 and rear end of the pivot arm channel 107 are thus biased against the protrusions 104*a* and 104*b*. When the vacuum squeegee is lowered to the floor, as seen in FIG. 2, the actuator arm 116 extends and allows the linkage 106 to rotate. The unique shape of the pivot arm channel 107 allows the actuator arm 116 to extend outward even though the linkage 106 is rotating. When the squeegee contacts the floor, its weight is no longer acting on the horizontal pulley 108 and in turn biasing the support bar notch 115 and rear end of the pivot arm channel 106 firmly against the protrusions 104*a* and 104*b*. The actuator arm 116 continues to extend such that it disengages the support bar notch 115 and rear end of the pivot arm channel 107.

The fact that the actuation aspect of the device disengages from the lifting aspect of the device is an advantage since the vacuum squeegee swings outside of the floor cleaning machine and draws extra cable line. If the actuation aspect did not disengage from the linkage 106 and support bar 105, then the cable may become slack, and its behavior would be unpredictable and destructive. A slack cable may push off of a pulley and twist, bind or rub on nearby components.

Figure 4:
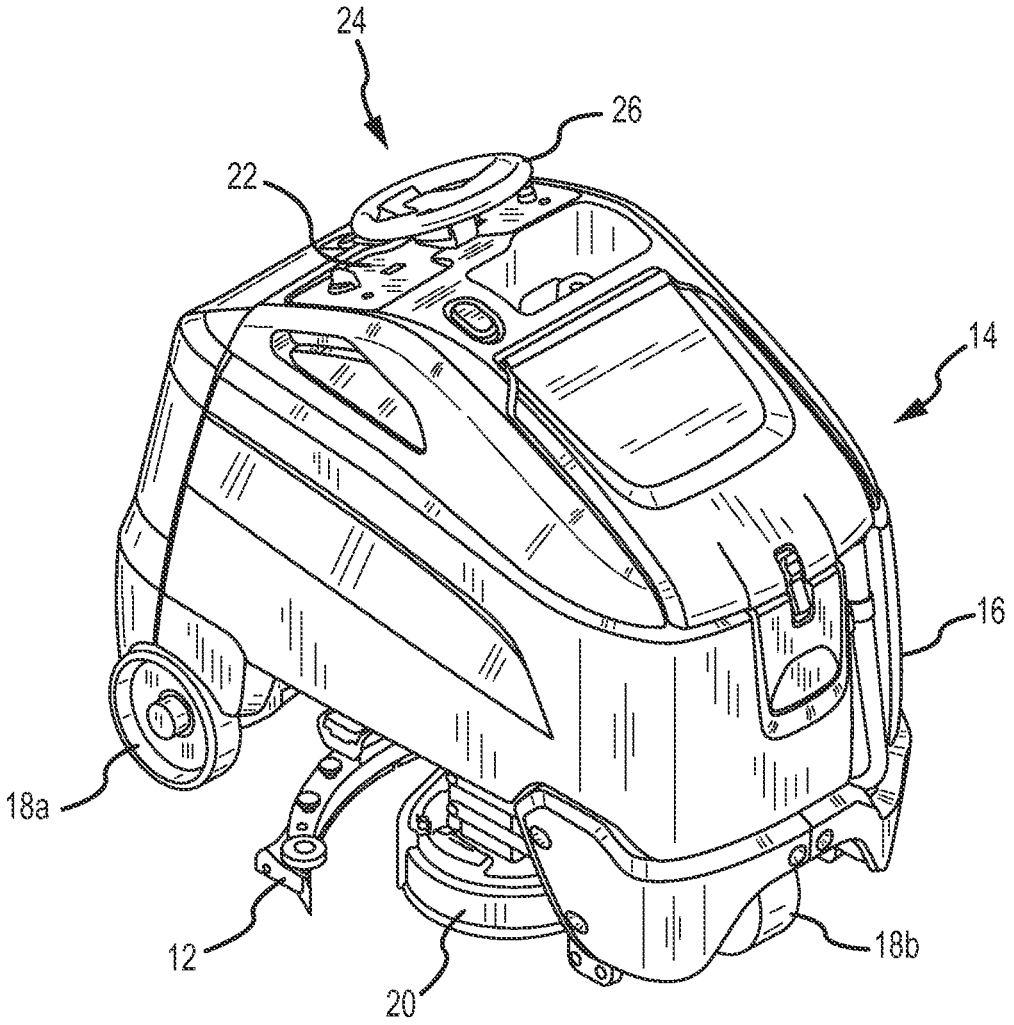
FIG. 4 is a view of the vacuum squeegee assembly attached to a cleaning device according to one embodiment of the present disclosure.

FIG. 4 depicts one embodiment of the present invention wherein a floor cleaning device 14 comprises a cable lift system in accordance with the present disclosure, the cable lift system operable to raise and lower components of the device 14, such as a squeegee 12 and/or cleaning pad 20. The floor cleaning device 14 comprises a chassis 16 movable on a plurality of wheels 18*a*, 18*b*. In certain embodiments, the squeegee assembly (which may comprise more than one squeegee blade) is a separate component from the cleaning device 20 and the squeegee assembly 12 is in operable association with a cable lift system as shown and described herein. The cable lift system 101 is thus operable to raise and lower the squeegee assembly 12 based on user preference. The system 101 may be activated by a switch 22 or control provided on a user-interface panel 24. The user-interface panel 24 comprises various user-operated controls, including a steering wheel 26 for manipulating the device 14. In certain embodiments, various features including the squeegee assembly 12 and cleaning devices 20 are combined or integrated onto a single "deck," wherein the deck is vertically translatable by a cable lift system 101 between a raised position and a lowered position, the lowered position characterized in that at least one component is in contact with a surface or floor upon which the device 14 is situated.

While various embodiments of the present invention have been described in detail, it is apparent that modifications and alterations of those embodiments will occur to those skilled in the art. However, it is to be expressly understood that such modifications and alterations are within the scope and spirit of the present disclosure. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A cable actuated lift device, comprising:

a cable having a predetermined length;

a first end of the predetermined length of cable provided in force transmitting communication with a linear actuator;

a second end of the predetermined length of cable provided in force transmitting communication with a surface cleaning device;

the linear actuator comprising an extended and retracted position, and adapted to extend and retract the predetermined length of cable, wherein the extended position of the linear actuator corresponds to the surface cleaning device being provided in contact with a surface and the retracted position corresponds to the surface cleaning device being provided in a raised position with respect to the surface;

the linear actuator provided in force-transmitting communication with a first pulley, wherein the first pulley comprises a substantially vertical axis of rotation, and wherein the first pulley is translatable in a horizontal plane based on a movement of the linear actuator;

the predetermined length of cable extending in a first direction and a second direction, wherein the cable is provided in contact with the first pulley and a second pulley, wherein the second pulley is provided at a transition point between the first direction and the second direction;

the second pulley being rotatable about a first substantially horizontal axis that is substantially perpendicular to the substantially vertical axis;

the second pulley being pivotable about a second substantially horizontal axis; and wherein pivoting of the second pulley about the second substantially horizontal axis permits translation of the surface cleaning device at least when the surface cleaning device is provided in contact with the surface to be cleaned, and wherein the first pulley is displaceable relative to the second pulley when the linear actuator is operated.

2. The cable actuated lift device of claim 1, wherein the linear actuator comprises a powered piston.

3. The cable actuated lift device of claim 1, wherein the linear actuator comprises a servo-motor.

4. The cable actuated lift device of claim 1, wherein the surface cleaning device comprises a squeegee.

5. The cable actuated lift device of claim 1, wherein the surface cleaning device comprises at least one of a brush, a burnisher, a roller, and a pad.

6. The cable actuated lift device of claim 1, wherein the linear actuator is selectively positioned between at least the extended and retracted position by a user input.

7. The cable actuated lift device of claim 1, wherein the first direction comprises a substantially horizontal direction.

8. The cable actuated lift device of claim 1, wherein the second direction is substantially perpendicular to the first direction.

9. A cable actuated lift device, comprising:

a cable having a predetermined length;

a first end of the predetermined length of cable secured to a first pulley and provided in force transmitting communication with a linear actuator by a rotatable linkage member and the first pulley, wherein the first pulley is translatable in a substantially horizontal plane based on a movement of the linear actuator;

a second end of the predetermined length of cable provided in force transmitting communication with a surface cleaning device;

the linear actuator comprising an extended and retracted position, and adapted to extend and retract the predetermined length of cable by imparting force to the rotatable linkage member and the first pulley, wherein the extended position of the linear actuator corresponds to the surface cleaning device being provided in contact with a surface and the retracted position corresponds to the surface cleaning device being provided in a raised position with respect to the surface;

the predetermined length of cable extending in a first direction and a second direction, wherein the cable is provided in contact with a second pulley at a transition point between the first direction and the second direction;

the second pulley secured to the device at an axle and wherein the second pulley is pivotable about an axis of the axle to allow movement of the surface cleaning device, and wherein the second pulley is rotatable about an axis;

wherein pivoting of the second pulley about the second axis permits translation of the surface cleaning device at least when the surface cleaning device is provided in contact with a surface;

a frame provided above the surface cleaning device, wherein the second pulley is connected to the frame, and wherein the frame comprises a channel and wherein the first pulley travels in a path defined by the channel and wherein the first pulley is displaceable relative to the second pulley during operation of the linear actuator.

10. The cable actuated lift device of claim 9, wherein the second direction is substantially perpendicular to the first direction.

11. The cable actuated lift device of claim 9, wherein the linear actuator comprises at least one of a hydraulic piston, a servo-motor, and a gear system.

12. The cable actuated lift device of claim 9, wherein the surface cleaning device comprises at least one of a squeegee, a brush, a burnisher, a roller, and a pad.

13. The cable actuated lift device of claim 1, wherein the linear actuator is selectively positioned between at least the extended and retracted position by a user input.

* * * * *